US005295598A

United States Patent [19]

Gerlach et al.

[11] Patent Number: 5,295,598

[45] Date of Patent: Mar. 22, 1994

[54] DRINKING VESSEL AND RETAINER THEREFOR

[76] Inventors: David D. Gerlach, 31699 S. River, Apt. F, Mt. Clemens, Mich. 48045; Michael V. Badalamente, 70441 Dutchess, Romeo, Mich. 48065

[21] Appl. No.: 903,561

[22] Filed: Jun. 24, 1992

[51] Int. Cl.[5] ..... B63B 35/02

[52] U.S. Cl. ..... 215/100 R; 220/630; 229/1.5 H; 248/346.1

[58] Field of Search ..... 215/100 R, 100.5; 229/1.54, 1.53; 220/628, 630, 634, 636; 248/346.1

[56] References Cited

U.S. PATENT DOCUMENTS

| | | | |
|---|---|---|---|
| 2,601,767 | 7/1952 | Wall | 220/719 |
| 2,704,444 | 3/1955 | Carew | 229/1.54 X |
| 2,755,011 | 7/1956 | Carew | 229/1.5 H |
| 2,905,351 | 9/1959 | Lerner | 215/100 R |
| 2,963,256 | 12/1960 | Borah | 215/100.5 |
| 3,482,724 | 12/1969 | Heaton | 215/100 R |
| 3,610,456 | 10/1971 | Marsh | 215/100 R |
| 3,831,209 | 8/1974 | Clingman | 248/346.1 X |
| 3,927,782 | 12/1975 | Edwards | 215/100 R |
| 4,040,549 | 8/1977 | Sadler | 215/100 R |
| 4,241,839 | 12/1980 | Alberghini | 215/100 R |
| 4,442,944 | 4/1984 | Yoshino et al. | 215/100 R X |
| 4,573,604 | 3/1986 | Guim . | |
| 4,919,284 | 4/1990 | Tiedemann et al. | 215/100 R X |
| 4,932,621 | 6/1990 | Kowk . | |
| 5,044,515 | 9/1991 | Straub | 215/100 R X |
| 5,046,587 | 9/1991 | Jones | 248/346.1 X |

FOREIGN PATENT DOCUMENTS

| | | | |
|---|---|---|---|
| 1925806 | 10/1970 | Fed. Rep. of Germany | 229/1.5 H |
| 2599235 | 12/1987 | France | 215/100 R |

*Primary Examiner*—Allan N. Shoap
*Assistant Examiner*—Christopher McDonald
*Attorney, Agent, or Firm*—Harness, Dickey & Pierce

[57] ABSTRACT

The present invention relates to drinking vessels and more particularly to drinking vessels having an arcuate bottom which will not allow the drinking vessel to be positioned atop a substantially planer surface unless a specially adapted coaster is utilized. The drinking vessel includes a body having an upper portion including an opening for receiving and dispensing liquids and a bottom having a substantially arcuate outer surface. The coaster includes a recessed area for fittingly receiving the arcuate bottom of the drinking vessel and optionally a groove for receiving a portion of a handle which projects from the drinking vessel.

11 Claims, 1 Drawing Sheet 16
14
12
26
22
28
18
32
24
30
34
20
10
36
44
46
40
48
42
40

40
38
12a
26a
22a
28a
18a
32a
24a
10a 46a
36a
48a
22b
12b
24b
10b
32b 46b
50b
48b
36b
22c
14c
18c
20c
32c
10c
44c
46c
40c

18c 44d
36d
12c
50d
48d
46d
32c
12c
14c
44c
10c
20c 46c
38c
32c

DRINKING VESSEL AND RETAINER THEREFOR

BACKGROUND OF THE INVENTION

1. Technical Field

The present invention relates to drinking vessels and, more particularly, to drinking vessels which will tip over if positioned on the bottom surface thereof unless a specially adapted coaster is utilized to maintain the drinking vessel in an upright position.

2. Discussion of Related Art

Many drinking containers are known which include a bottom designed to maintain the container in an upright position and which have an upwardly extending cylindrical portion for retaining the contents. The planar bottom surfaces are designed to come to rest contiguously upon another planar support surface when the drinking container is not held by an individual. If a sufficient force is subjected upon the container at anyone of a number of different angles, the planar surface of the drinking container will become disengaged from the planar support surface causing the container to tip over and discharge the contents.

Other drinking vessels are also known which attempt to preclude spillage of the contents contained therein. For example, U.S. Pat. No. 2,601,767 discloses a drinking container having an arcuate bottom which contains weighting for self-righting the container in the event that a force is subjected upon the container which is sufficient to cause the container to tip over. This type of drinking container requires that a false bottom be disposed within the cylindrical portion of the cup to maintain the weighting in the bottom of the drinking container.

Heretofore, there are no drinking containers which will tip over if placed directly upon a planar surface. Under certain circumstances, it may be desirable to provide a drinking container which cannot be positioned solely upon a planar support surface without spilling the contents thereof. For instance, when it is desired that an individual, such as an infant, drink the entire amount of liquid originally placed in the drinking container, the present invention would be useful. Unless all of the liquid has been consumed, the drinking container cannot be put down without spilling the contents. The detachability and specific way the drinking vessel and coaster fit together serve the additional function of teaching hand and eye coordination. Additionally, the drinking vessel of the present invention is useful as a novelty item for a practical joke where it is desirable that someone be forced to hold onto their drinking vessel so as to not spill the contents.

It is therefore a primary object of the present invention to provide a drinking vessel which will spill the contents thereof, unless substantially all of the liquid contained therein has been consumed or otherwise emptied from the containment area.

It is another object of the present invention to provide in combination a drinking vessel having a substantially arcuate bottom surface and a specially adapted coaster for detachably maintaining the drinking vessel in an upright position.

It is yet another object of the present invention to provide a selectively interconnecting drinking vessel and coaster arrangement which enhances the hand and eye coordination of small children.

Yet another object of the present invention is to provide a drinking vessel which can be used to effectuate a practical joke.

SUMMARY OF THE INVENTION

The present invention, therefore, relates to a drinking vessel having an arcuate bottom and an upwardly extending portion wherein the contents of the container will be spilled if the container is set down on its bottom or outer surface. The drinking container typically comprises a body portion, an arcuate bottom and a hollow containment area located within the body portion. The arcuate bottom can be integral with the body portion or can be provided with a transitional step to separate the arcuate bottom from the body portion. The drinking container can be provided with a handle which extends from the outer surface of the body portion. Specially designed coasters are also provided which allow the user to set the drinking container down without spilling the contents of the drinking container.

Additional objects and advantages of the present invention will become apparent from reading of the detailed description of the preferred embodiments which make reference to the following set of drawings in which:

DETAILED DESCRIPTION OF THE PREFERRED EMBODIMENT

Figures 1, 2, 3, 4, 5, 6, 7:
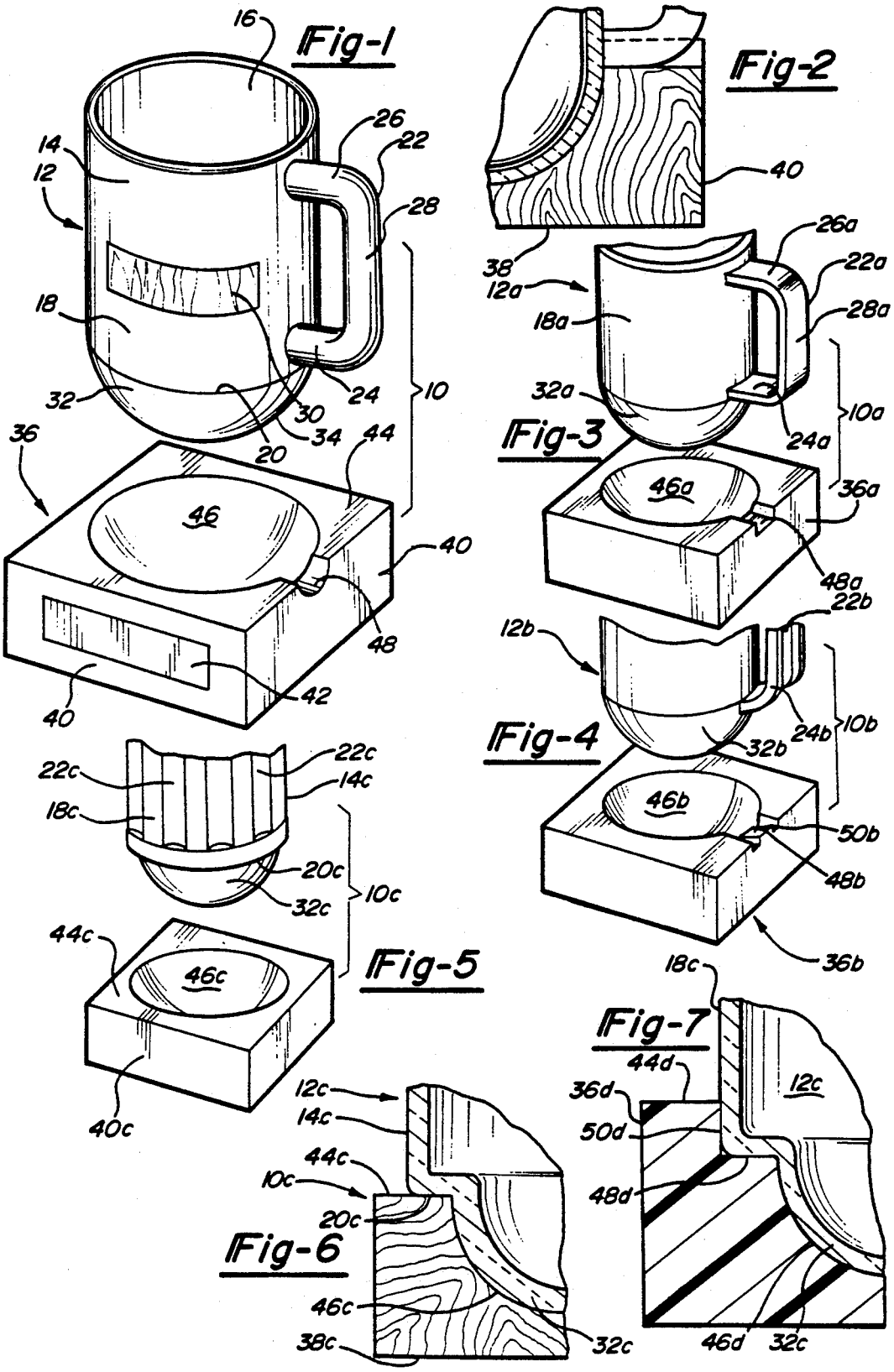
FIG. 1 is a perspective view demonstrating a first embodiment of the drinking container and specially adapted coaster of the present invention.
FIG. 2 is a partial cross-sectional view of the drinking container and coaster of FIG. 1 shown in a mated position.
FIG. 3 is a perspective view demonstrating a second embodiment of the drinking container and specially adapted coaster of the present invention.
FIG. 4 is a perspective view demonstrating a third embodiment of the drinking container and a specially adapted coaster of the present invention.
FIG. 5 is a perspective view demonstrating a fourth embodiment of the drinking container and a specially adapted coaster of the present invention.
FIG. 6 is a partial cross-sectional view of the embodiment of FIG. 5 wherein the drinking container is provided with a transitional stop which separates the arcuate bottom and the body portion.
FIG. 7 is a partial cross-sectional view of the drinking container of FIG. 6 wherein the coaster has been modified.

Referring to the Figures and more particularly to FIG. 1, a drinking vessel and retainer assembly according to the present invention is shown. The drinking vessel 12 includes a body having a substantially hollow cylindrical upper portion 14, a closed bottom 32 and an outwardly projecting handle 20. The upper portion 14 is defined by the inner and outer surfaces 16 and 18, respectively, occurring above the point 20 where the upper portion 14 and the bottom 32 merge. The area defined by the inner surface is known as the containment area. The outer surface 16 which can include a variety of decorative features is optionally provided with an area 30 for advertising or for placing an individual's name. Extending outwardly from the outer surface 18 is a handle 22 which includes first and second horizontally extending portions 24 and 26, respectively, and a vertically extending portion 28 located therebetween. The bottom 32 is defined by the area located below point 20 and is provided with an arcuate outer surface 34. This arcuate outer surface 34 causes the drinking vessel 12 to tip over when the arcuate outer surface is positioned directly upon a substantially planar surface (not shown) such as a table top or counter. The drinking vessel 12 can be made from a number of different materials including glass, ceramics, plastic, metal, crystal and polymer-based materials.

A specially adapted coaster 36 is provided which allows the drinking vessel 12 to be maintained in an upright position when the user (not shown) releases the handle 22. This coaster 36 may be made from ceramic, wood, glass, crystal, rigid plastic or a polymer based material. The coaster 36 typically includes a relatively planar bottom surface 38 which rests upon a planar supporting surface such as the above-mentioned table top or counter. Coaster 36 is further provided with side walls 40 which can also be provided with an area 42 for advertising or for placing an individual's name. A top surface 44 of the coaster 36 includes a substantially concave recess 46 designed to matingly receive the bottom 32 of the drinking vessel 12. Extending into the recess and disposed below the top surface 44 is a groove 48 which hosts the horizontally extending portion 24 of handle ? S. As demonstrated more clearly in FIG. 2, horizontally extending portion 24 is positioned within the groove 48 sufficiently deeply to preclude lateral movement of the drinking vessel 12 while the bottom 32 is engaged within the recess 46. In this embodiment, the horizontally extending portion 24 of the handle 22 extends less than half way above the top surface 44 of the coaster 36. Typically, the coaster 36 is sufficiently wide to project laterally beyond the outer surface of the drinking vessel to provide added support. The height of the coaster can be varied provided the height is sufficient to accommodate a recess having a depth equal to that of the bottom of the drinking vessel.

Referring to FIG. 3, a second embodiment of the drinking container and specially adapted coaster of the present invention is shown. The embodiment is essentially the same as that disclosed in FIG. 1 except that the handle has been modified. Since many of the features of this embodiment are similar to those described with reference to FIGS. 1 and 2, the same reference numerals accompanied by a distinguishing lefter character will be used to designate similar features. The handle **22*a* which extends from the upper portions 18*a* has been modified to be relatively flat. The handle 22*a* still includes horizontally extending portions 24*a* and 26*a*, respectively, and vertically extending portion 28*a*. Coaster 36*a* includes substantially concave recessed portion 46*a* and groove 48*a*. When the drinking vessel 12*a* is properly placed on the coaster 36*a*, the horizontally extending portion 24*a* comes to rest contiguously atop the relatively flat groove 48*a*. Again, the horizontally extending portion 24*a* is positioned sufficiently deeply within the groove 48*a* to preclude lateral movement of the drinking vessel 12*a***.

Referring to FIG. 4, a third embodiment **10*b* of the drinking vessel and specially adapted coaster of the present invention is shown. The drinking vessel 12*b* is provided with a handle 22*b* having outwardly projecting flanges 24*b*. When the bottom 32*b* of the drinking vessel is positioned within the substantially concave recessed portion 46*b* of the coaster 36*b*, the flanges 24*b* fittingly mate with slots 50*b* contained in groove 48*b* to further preclude lateral movement of the drinking vessel 12*b***.

Referring to FIGS. 5 and 6, a fourth embodiment **10*c* of the drinking vessel and specially adapted coaster of the present invention is shown. The drinking vessel 12*c* includes a body having a substantially cylindrical upper portion 14*c* and a closed bottom 32*c*. The upper portion 14*c* is defined by the area occurring above the step 20*c* which separates the upper portion 14*c* from the bottom 32*c*. The outer surface 18*c* is provided with a series of alternating channels 22*c* which facilitate grasping the drinking vessel 12*c*. The bottom 32*c* is defined by the area located below point 20*c* and is provided with an arcuate outer surface 34*c*. This arcuate outer surface 34*c* causes the drinking vessel 12*c* to tip over when the arcuate outer surface 34*c*** is positioned directly upon a substantially planer surface such as a table top or counter.

Coaster **36*c* is provided with a relatively planar bottom surface 38*c*, side walls 40*c* and a top surface 44*c*. Top surface 44*c* includes a substantially concave recessed area 46*c* designed to matingly receive the bottom 32*c* of drinking vessel 12*c*. As shown more clearly in FIG. 6, the arcuate outer surface 34*c* comes to rest contiguously against the recessed portion 46*c* of coaster 36*c*. The step 20*c* comes to rest upon the top surface 44*c* which precludes the drinking vessel 12*c*** from wobbling.

FIG. 7 demonstrates a modified coaster which can be utilized with the drinking vessel shown in FIG. 6. The coaster **36*d* is provided with a recessed area 46*d* and a top surface 44*d* as in the previous embodiments. In addition, the coaster 36*d* is provided with a circumferential ledge 48*d* located below the top surface 44*d* and above the substantially concave recessed area 4*d*. When the drinking vessel 12*c* is positioned upon the coaster 36*d*, the transitional step 20*d* of the drinking vessel 12*c* comes to rest upon the ledge 48*d* and the outer surface 18*c* of the drinking vessel 12*c* is contiguous against blocking wall 50*d* to maintain the drinking vessel 12*c*** in an upright position.

Various modifications of the structures of the present invention will be apparent to those skilled in the art. For example, each of the drinking vessels can be provided with a handle or a transitional step which separates the body portion from the bottom of the drinking vessel. It is also contemplated that the shape of the drinking vessel's bottom can take on various other shapes such as a conical shape and still require a specially adapted coaster to position the drinking vessel upon a planar surface. Likewise, the specially adapted coaster can take on a variety of overall shapes provided there is still a recessed portion.

While the above description constitutes the preferred embodiment of the present invention, it is to be appreciated that the invention is susceptible to modification, variation and change without departing from the proper scope and the fair meaning of the accompanying claims.

We claim:

1. A container assembly, comprising:

a drinking vessel having a body which includes an upper portion having inner and outer surfaces and an open first end, a bottom having a substantially arcuate outer surface and a handle projecting from the outer surface of said upper portion; and coaster means for detachably securing said drinking vessel in an upright position, said coaster means including a bottom surface, a top surface and at least one side wall with said top surface extending from the at least one side wall, extending into said top surface is a substantially concave recessed area for fittingly engaging the bottom of said drinking vessel, said coaster means including a groove extending from said substantially concave recessed area below said top surface for receiving at least a portion of said handle to preclude lateral movement of said drinking vessel relative to said coaster means.

2. The container assembly according to claim 1, wherein said groove includes at least one slot for receiving an outwardly projection portion contained on said handle means.

3. The container assembly according to claim 1, wherein said drinking vessel is provided with a transitional step separating said upper portion from said bottom; and said coaster means is provided with a circumferential ledge located below said top surface and extending from said recessed portion, said circumferential ledge serving to host the transitional step of said drinking vessel.

4. The container assembly according to claim 1, wherein said drinking vessel is made from a material selected from the group consisting of glass, plastic, crystal, ceramics, metal or a polymer based material.

5. The container assembly according to claim 1, wherein said coaster is made from a material selected from the group consisting of glass, plastic, crystal, ceramics, metal, wood or a polymer based product.

6. The container assembly according to claim 1, wherein the outer surface of said upper portion is provided with an area for displaying a message.

7. A container assembly comprising:

a drinking vessel having a body which includes an upper portion having inner and outer surfaces and an open first end, a bottom having a substantially arcuate outer surface and a handle projecting from the outer surface of said upper portion, said handle including at a gripping portion and a projecting portion extending from said gripping portion; and coaster means for detachably securing said drinking vessel in an upright position, said coaster means including a bottom surface, a top surface and at least one side wall, extending into said top surface is a recessed area for fittingly engaging the bottom said drinking vessel, said coaster means including a groove extending below said top surface for receiving at least a portion of said handle, said groove including at least one slot for receiving the projecting portion of said handle to preclude lateral movement of said drinking vessel relative to said coaster means.

8. The container assembly according to claim 7, wherein said drinking vessel is provided with a transitional step separating said upper portion from said bottom; and said coaster means is provided with a circumferential ledge located below said top surface and extending from said recessed portion, said circumferential ledge securing to host the transitional step of said drinking vessel.

9. The container assembly according to claim 7, wherein said coaster means include an area for displaying a message on said at least one side wall.

10. The container assembly according to claim 7, wherein said drinking vessel is made from a material selected from the group consisting of glass, plastic, crystal, ceramics, metal or a polymer based material.

11. The container assembly according to claim 7, wherein said coaster is made from a material selected from the group consisting of glass, plastic, crystal, ceramics, metal, wood or a polymer based product.

* * * * *